US007134899B1

(12) United States Patent
Huang

(10) Patent No.: US 7,134,899 B1
(45) Date of Patent: Nov. 14, 2006

(54) ELECTRICAL CONNECTOR ASSEMBLY

(76) Inventor: George Ying-Liang Huang, 9 Studebaker, Irvine, CA (US) 92618

( * ) Notice: Subject to any disclaimer, the term of this patent is extended or adjusted under 35 U.S.C. 154(b) by 0 days.

(21) Appl. No.: 11/283,979

(22) Filed: Nov. 21, 2005

(51) Int. Cl.
*H01R 13/627* (2006.01)

(52) U.S. Cl. ..... 439/352; 439/362

(58) Field of Classification Search ..... 439/352, 439/362, 676, 357
See application file for complete search history.

(56) References Cited

U.S. PATENT DOCUMENTS 4,362,348 A * 12/1982 Stephenson et al. ..... 439/258
4,577,919 A * 3/1986 Waters ..... 439/597
4,597,620 A * 7/1986 Lindner et al. ..... 439/277
4,961,711 A * 10/1990 Fujiura et al. ..... 439/357
5,021,002 A * 6/1991 Noschese ..... 439/352
5,044,975 A * 9/1991 DiBene et al. ..... 439/352
5,197,900 A * 3/1993 Ellis et al. ..... 439/352
5,411,402 A * 5/1995 Bethurum ..... 439/77
5,411,415 A * 5/1995 Embo et al. ..... 439/610
5,647,758 A * 7/1997 Ichikawa et al. ..... 439/362
6,273,742 B1 * 8/2001 Castagna et al. ..... 439/362
6,776,665 B1 * 8/2004 Huang ..... 439/676

* cited by examiner

*Primary Examiner*—Tulsidas C. Patel
*Assistant Examiner*—Vladimir Imas
(74) *Attorney, Agent, or Firm*—Whyte Hirschboeck Dudek SC

(57) ABSTRACT

An electrical connector assembly includes a first electrical connector having conductive contacts disposed in a receiving space in an insertion end portion of a first housing. A second electrical connector includes a terminal-mounting seat disposed in a hollow second housing and mounted with conductive terminals. When the insertion end portion of the first housing is inserted into the second housing, the terminal-mounting seat is received fittingly in the receiving space in the insertion end portion of the first housing, and the conductive terminals contact electrically and respectively the conductive contacts. A fastening unit prevents relative movement between the first and second housings so as to maintain electrical contact between the conductive contacts and the conductive terminals.

7 Claims, 5 Drawing Sheets

ELECTRICAL CONNECTOR ASSEMBLY

BACKGROUND OF THE INVENTION

1. Field of the Invention

The invention relates to an electrical connector assembly, more particularly to an electrical connector assembly that includes a fastening unit for preventing relative movement between two connectors when the connectors are electrically interconnected.

2. Description of the Related Art

FIGS. 1 and 2 illustrate a conventional electrical connector assembly that can be used for signal transmission via an HDMI interface and that includes a first electrical connector 1 and a second electrical connector 2. The first electrical connector 1 includes a first housing 10 that has an insertion end portion 11 formed with a receiving space 14, and a set of conductive contacts 12 disposed in the receiving space 14 and connected electrically to another electrical connector (not shown) via a cable 13. The second electrical connector 2 includes a hollow second housing 20 having an opening 23, and a set of conductive terminals 22 mounted on a terminal-mounting seat 21 that is disposed in the second housing 20. When the insertion end portion 11 of the first housing 10 of the first electrical connector 1 is inserted into the second housing 20 via the opening 23, the terminal-mounting seat 21 is received fittingly in the receiving space 14 in the insertion end portion 11 of the first housing 10, and the conductive contacts 12 of the first electrical connector 1 contact electrically and respectively the conductive terminals 22 of the second electrical connector 2.

However, in such a configuration, electrical contact between the conductive contacts 12 of the first electrical connector 1 and the conductive terminals 22 of the second electrical connector 2 cannot be maintained when the first and second housings 10, 20 are subjected to unintentional vibration or wobbling. As a result, stable signal transmission by the conventional electrical connector assembly cannot be ensured.

SUMMARY OF THE INVENTION

Therefore, the object of the present invention is to provide an electrical connector assembly that can ensure stable signal transmission.

According to the present invention, an electrical connector assembly comprises:

a first electrical connector including a first housing that has an insertion end portion extending along a direction and formed with a receiving space that is defined by an inner wall surface, and a set of conductive contacts disposed in the receiving space and mounted on the inner wall surface;

a second electrical connector including a hollow second housing that has an opening and that permits extension of the insertion end portion of the first housing thereinto via the opening, a terminal-mounting seat disposed in the second housing and received fittingly in the receiving space in the insertion end portion of the first housing when the insertion end portion of the first housing is inserted into the second housing, and a set of conductive terminals mounted on the terminal-mounting seat and contacting electrically and respectively the conductive contacts of the first electrical connector when the insertion end portion of the first housing is inserted into the second housing; and a fastening unit provided on the first and second housings for preventing relative movement between the first and second housings when the insertion end portion of the first housing is inserted into the second housing so as to maintain electrical contact between the conductive contacts of the first electrical connector and the conductive terminals of the second electrical connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
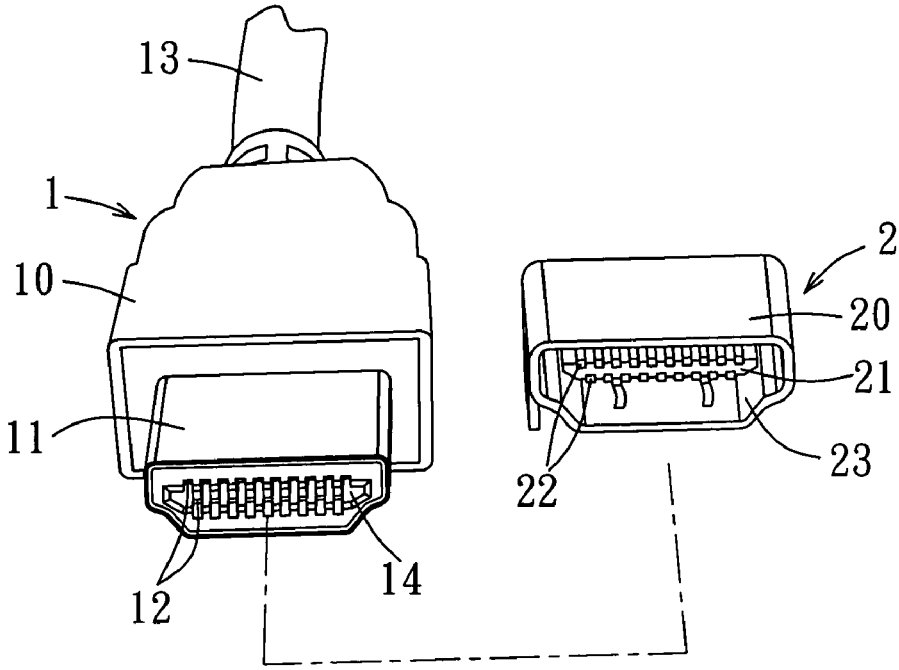
FIG. 1 PRIOR ART
FIG. 1 is an exploded perspective view of a conventional electrical connector assembly.
Figure 2:
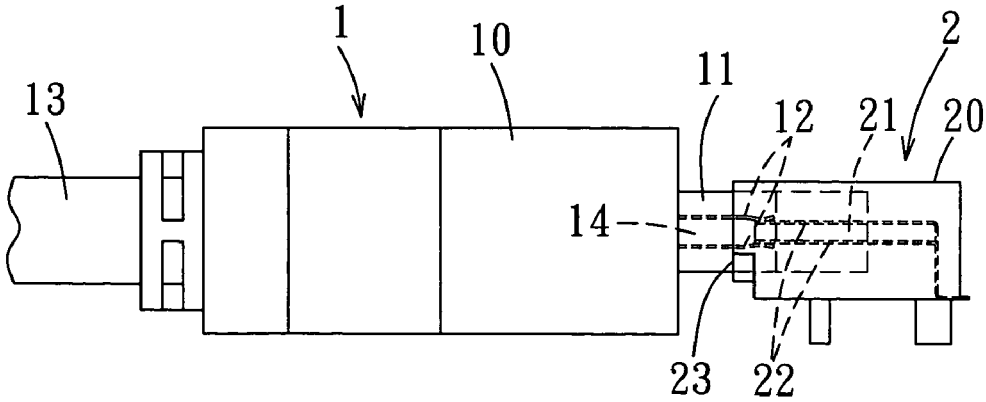
FIG. 2 PRIOR ART
FIG. 2 is an assembled schematic view of the conventional electrical connector assembly.

Before the present invention is described in greater detail, it should be noted that like elements are denoted by the same reference numerals throughout the disclosure.

Figure 3:
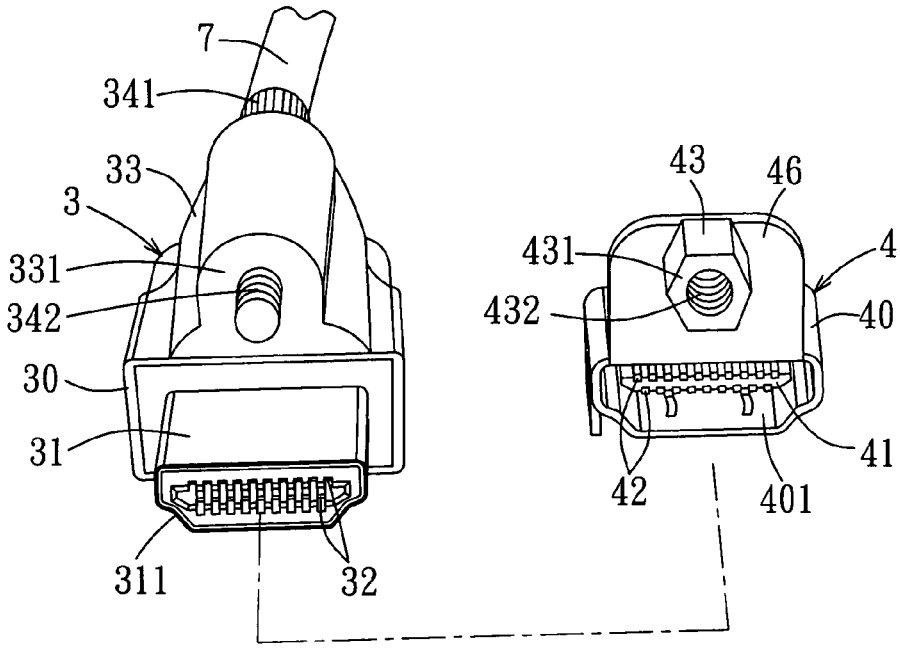
FIG. 3 is an exploded perspective view showing the first preferred embodiment of an electrical connector assembly according to the present invention.
Figure 4:
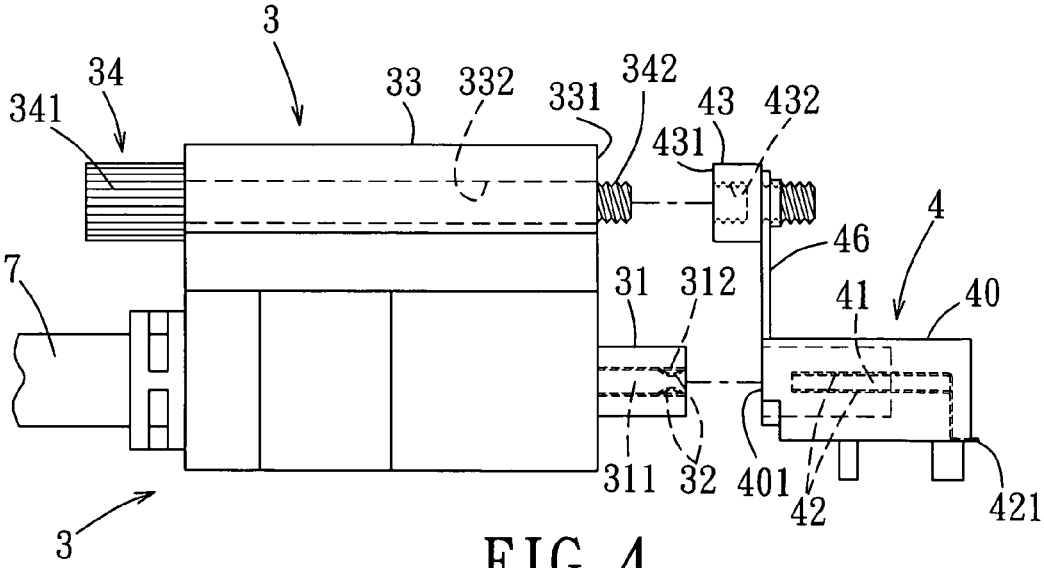
FIG. 4 is an exploded schematic view showing the first preferred embodiment.

Referring to FIGS. 3 and 4, the first preferred embodiment of an electrical connector assembly according to the present invention is shown to include a first electrical connector 3, a second electrical connector 4, and a fastening unit.

The first electrical connector 3 includes a first housing 30 that has an insertion end portion 31 extending along a direction and formed with a receiving space 311 that is defined by an inner wall surface 312, and a set of conductive contacts 32 disposed in the receiving space 311 and mounted on the inner wall surface 312. In this embodiment, the conductive contacts 32 are coupled electrically to a cable 7.

The second electrical connector 4 includes a hollow second housing 40 that has an opening 401 and that permits extension of the insertion end portion 31 of the first housing 30 thereinto via the opening 401, a terminal-mounting seat 41 disposed in the second housing 40 and received fittingly in the receiving space 311 in the insertion end portion 31 of the first housing 30 when the insertion end portion 31 of the first housing 30 is inserted into the second housing 40, and a set of conductive terminals 42 mounted on the terminal-mounting seat 41 and contacting electrically and respectively the conductive contacts 32 of the first electrical connector 3 when the insertion end portion 31 of the first housing 30 is inserted into the second housing 40. In this embodiment, the second housing 40 has an uprightly extending mounting plate 46 disposed adjacent to the opening 401. Each conductive terminal 42 has one end 421 that is adapted to be connected electrically to a circuit board (not shown).

The fastening unit is provided on the first and second housings 30, 40 for preventing relative movement between the first and second housings 30, 40 when the insertion end portion 31 of the first housing 30 is inserted into the second housing 40 so as to maintain electrical contact between the conductive contacts 32 of the first electrical connector 3 and the conductive terminals 42 of the second electrical connector 4. In this embodiment, the fastening unit includes a fastener-mounting seat 33, a coupling member 43 and a fastener 34. The fastener-mounting seat 33 is mounted fixedly on the first housing 30, and has an engagement surface 331, which is formed with a through hole 332 that extends through the fastener-mounting seat 33 along the direction. The coupling member 43 is mounted fixedly on the mounting plate 46 of the second housing 40 by a bolt 48, and has an engagement surface 431, which is formed with a thread hole 432. The fastener 34 is mounted movably and rotatably in the through hole 332 in the fastener-mounting seat 33, and has an operating end portion 341 extending outwardly of the fastener-mounting seat 33, and a threaded coupling end portion 342 opposite to the operating end portion 341. The operating end portion 341 is operated so as to enable the coupling end portion 342 to engage the thread hole 432 in the coupling member 43 when the insertion end portion 31 of the first housing 30 is inserted into the second housing 40.

When the electrical connector assembly of the present invention is used for high-frequency signal transmission, due to the presence of the fastening unit, electrical contact between the conductive contacts 32 of the first electrical connector 3 and the conductive terminals 42 of the second electrical connector 4 can be maintained, thereby ensuring stable signal transmission.

Figure 5:
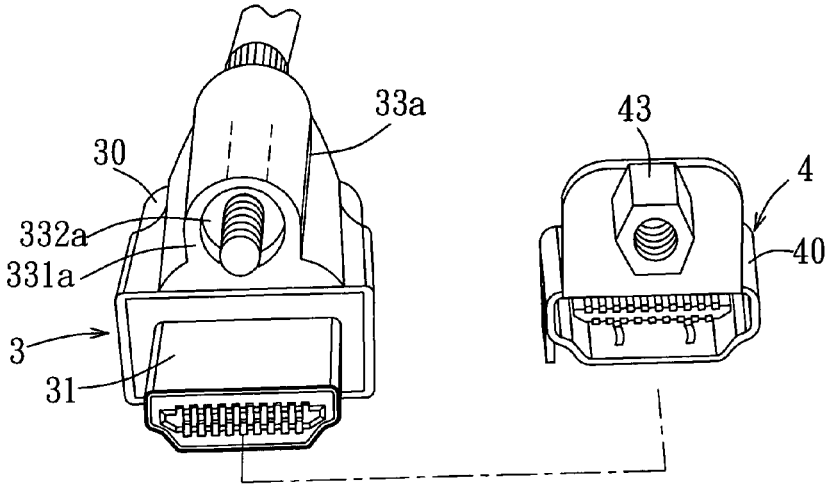
FIG. 5 is an exploded perspective view showing the second preferred embodiment of an electrical connector assembly according to the present invention.
Figure 6:
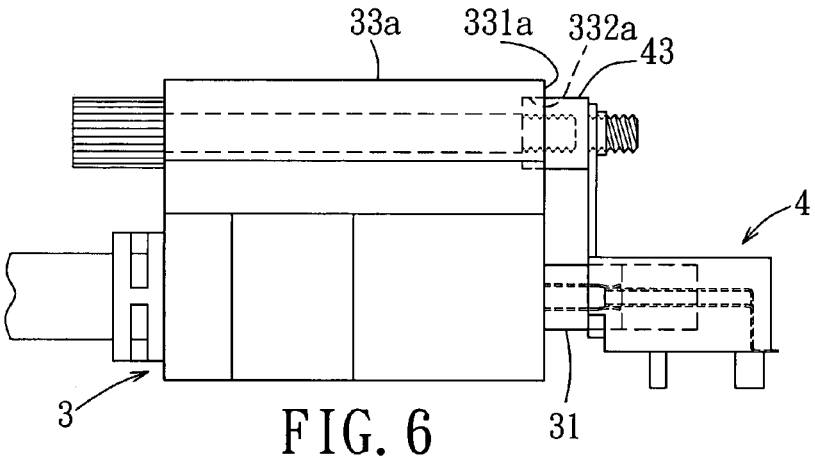
FIG. 6 is an assembled schematic view showing the second preferred embodiment.

FIGS. 5 and 6 illustrate the second preferred embodiment of an electrical connector assembly according to this invention, which is a modification of the first preferred embodiment. Unlike the previous embodiment, the engagement surface (331*a*) of the fastener-mounting seat (33*a*) is formed with a positioning groove (332*a*) for engaging fittingly an end of the coupling member 43, which is configured as a nut, when the insertion end portion 31 of the first housing 30 is inserted into the second housing 40. It is noted that, due to the presence of the positioning groove (332*a*), the insertion end portion 31 of the first housing 31 can be efficiently positioned even while the coupling end portion has not yet engaged the thread hole in the coupling member.

Figure 7:
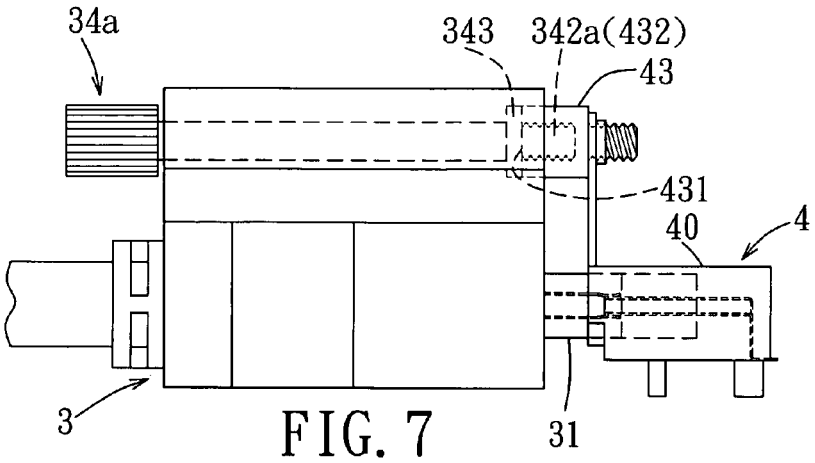
FIG. 7 is an assembled schematic view showing the third preferred embodiment of an electrical connector assembly according to the present invention.

FIG. 7 illustrates the third preferred embodiment of an electrical connector assembly according to this invention, which is a modification of the second preferred embodiment. Unlike the second preferred embodiment, the coupling end portion (342*a*) of the fastener (34*a*) is formed with a stop flange 343 extending radially and outwardly therefrom and abutting against the engagement surface 431 of the coupling member 43 when the coupling end portion (342*a*) of the fastener (34*a*) engages the thread hole 432 in the coupling member 43, thereby preventing damage to a threaded surface of the thread hole 432 in the coupling member 43 as a result of over-extension of the coupling end portion (342*a*) into the thread hole 432 in the coupling member 43.

Figure 8:
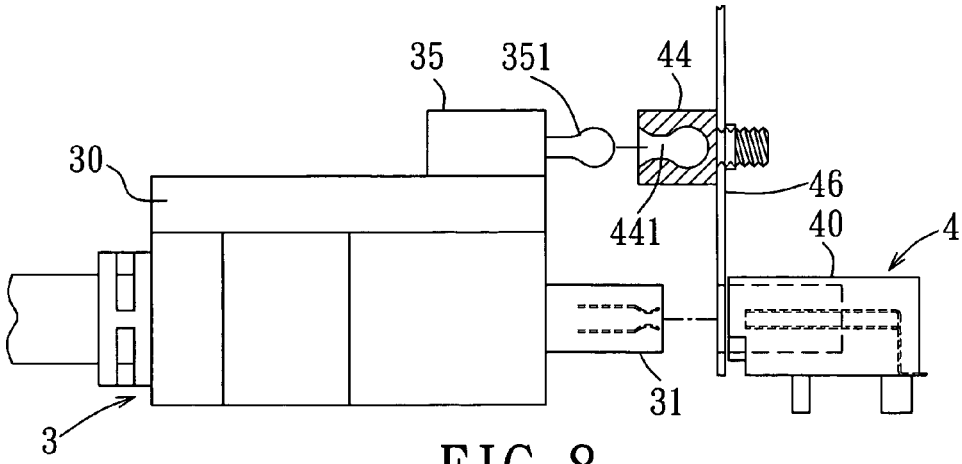
FIG. 8 is an exploded schematic partly sectional view showing the fourth preferred embodiment of an electrical connector assembly according to the present invention.

FIG. 8 illustrates the fourth preferred embodiment of an electrical connector assembly according to this invention, which is a modification of the first preferred embodiment. In this embodiment, the fastening unit includes a first coupling block 35 mounted fixedly on the first housing 30 and formed with an integral tongue 351, and a second coupling block 44 mounted fixedly on the mounting plate 46 of the second housing 40 and formed with an engaging groove 441. The engaging groove 441 engages fittingly the engaging tongue 351 on the first coupling block 35 when the insertion end portion 31 of the first housing 30 is inserted into the second housing 40.

Figure 9:
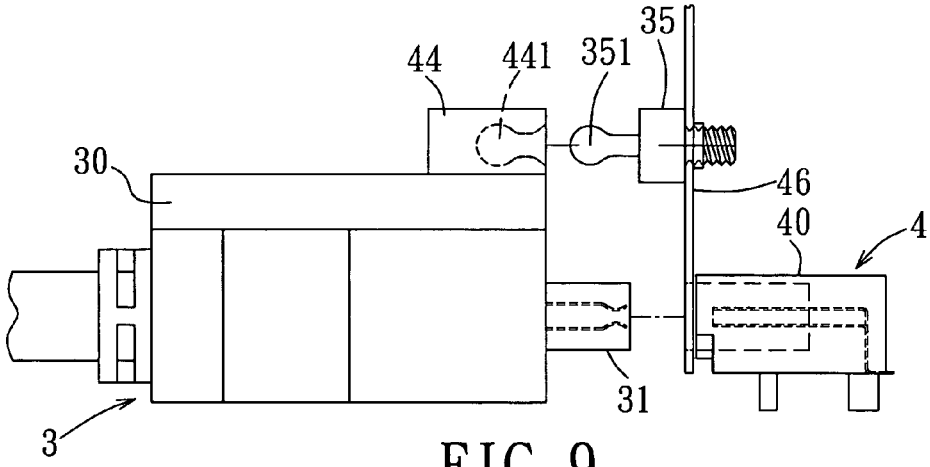
FIG. 9 is an exploded schematic view showing the fifth preferred embodiment of an electrical connector assembly according to the present invention.

FIG. 9 illustrates the fifth preferred embodiment of an electrical connector assembly according to this invention, which is similar to the fourth preferred embodiment shown in FIG. 8. In this embodiment, the first coupling block 35 is mounted fixedly on the mounting plate 46 of the second housing 40, and the second coupling member 44 is mounted fixedly on the first housing 30.

Figure 10:
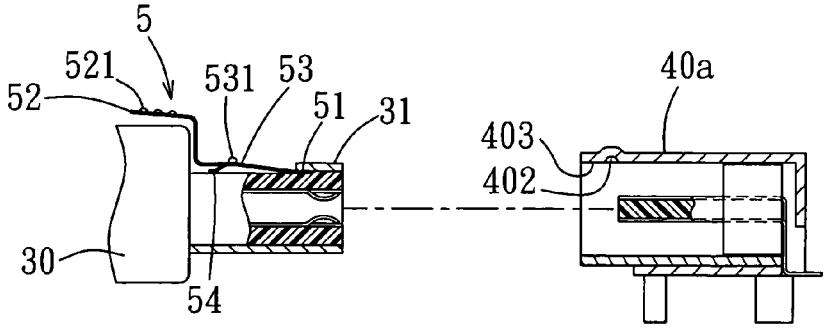
FIG. 10 is an exploded fragmentary, partly sectional, schematic view showing the sixth preferred embodiment of an electrical connector assembly according to the present invention.

FIG. 10 illustrates the sixth preferred embodiment of an electrical connector assembly according to this invention, which is a modification of the first preferred embodiment. In this embodiment, the second housing (40*a*) has an inner wall surface 402 formed with an engaging hole 403. The fastening unit includes a resilient member 5 having a mounting end portion 51, an operating end portion 52, an intermediate abutting member 53, and a biasing portion 54. The mounting end portion 51 is fixed on the insertion end portion 31 of the first housing 30. The operating end portion 52 is opposite to the mounting end portion 51, and is formed with a plurality of anti-slip ribs 521. The intermediate abutting portion 53 interconnects the mounting end portion 51 and the operating end portion 52, and abuts against the inner wall surface 402 of the second housing (40*a*) when the insertion end portion 31 of the first housing 30 is inserted into the second housing (40*a*). The intermediate abutting portion 53 is formed with an engaging projection 531 corresponding to the engaging hole 403 in the second housing (40*a*). The biasing portion 54 is connected to the intermediate abutting portion 53 for biasing the engaging projection 531 on the intermediate abutting portion 53 to engage the engaging hole 403 in the second housing (40*a*) when the insertion end portion 31 of the first housing 30 is inserted into the second housing (40*a*). In actual operation, the engaging projection 531 can be disengaged from the engaging hole 403 by pressing the operation end portion 52.

Figure 11:
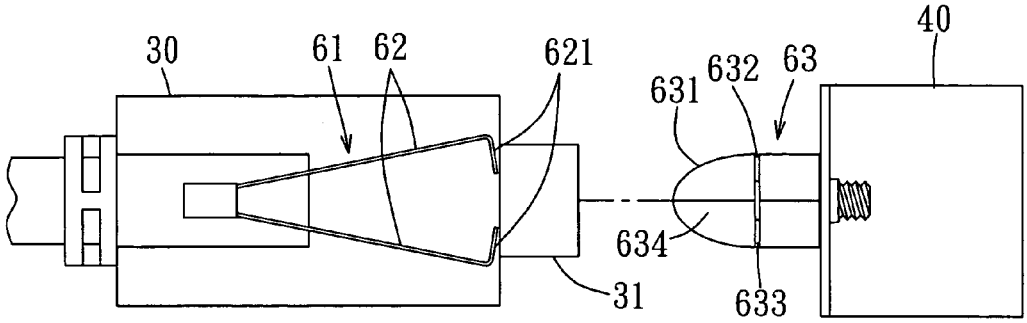
FIG. 11 is an exploded schematic top view showing the seventh preferred embodiment of an electrical connector assembly according to the present invention.
Figure 12:
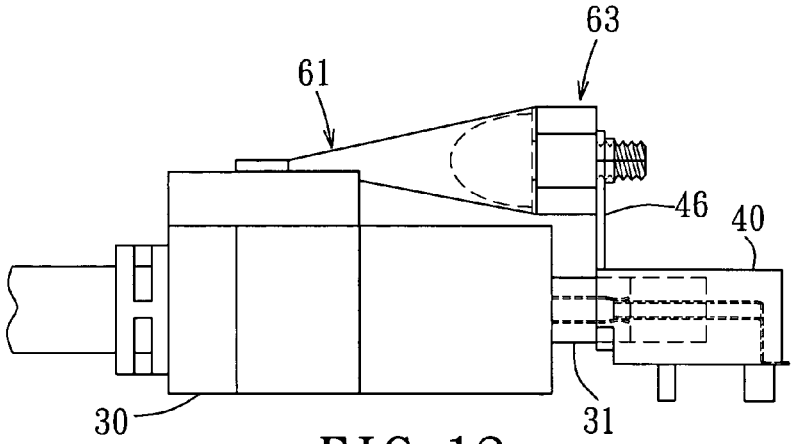
FIG. 12 is an assembled schematic view showing the seventh preferred embodiment.
Figure 13:
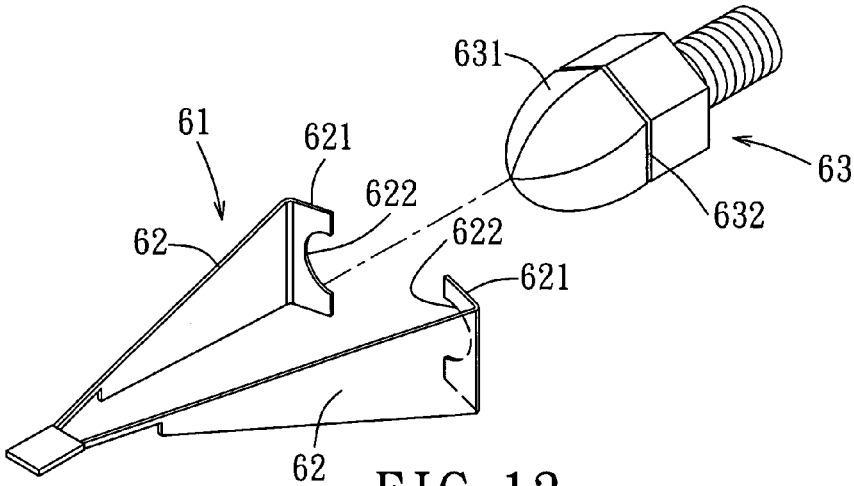
FIG. 13 is an exploded perspective view showing a fastening unit of the seventh preferred embodiment.

FIGS. 11 and 12 illustrate the seventh preferred embodiment of an electrical connector assembly according to this invention, which is a modification of the first preferred embodiment. In this embodiment, the fastening unit includes a clamper 61 and an engaging seat 62. The clamper 61 is mounted fixedly on the first housing 30, and has a pair of resilient clamping arms 62, each of which has a clamping plate end portion 621 extending toward the other one of the clamping arms 62 and formed with a notch 622, as best shown in FIG. 13. In this embodiment, the notch 622 in the clamping plate end portion 621 of each clamping arm 62 is semicircular. The engaging seat 63 is mounted fixedly on the second housing 40, and has an annular outer surface 631 that is formed with an annular groove 632 to define a neck portion 633 of the engaging seat 63. The annular groove 632 extends around the neck portion 633. The clamping plate end portions 621 of the clamping arm 62 of the clamper 61 engage the annular groove 632 in the engaging seat 63, and clamp the neck portion 633 of the engaging seat 63 therebetween when the insertion end portion 31 of the first housing 30 is inserted into the second housing 40. Preferably, the engaging seat 63 further has a tapered end portion 634 connected integrally to the neck portion 633 for guiding the clamping arms 62 to clamp the neck portion 633 of the engaging seat 63.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector assembly comprising:

a first electrical connector including a first housing that has an insertion end portion extending along a direction and formed with a receiving space that is defined by an inner wall surface, and a set of conductive contacts disposed in said receiving space and mounted on said inner wall surface;

a second electrical connector including a hollow second housing that has an opening and that permits extension of said insertion end portion of said first housing thereinto via said opening, a terminal-mounting seat disposed in said second housing and received fittingly in said receiving space in said insertion end portion of said first housing when said insertion end portion of said first housing is inserted into said second housing, and a set of conductive terminals mounted on said terminal-mounting seat and contacting electrically and respectively said conductive contacts of said first electrical connector when said insertion end portion of said first housing is inserted into said second housing; and a fastening unit provided on said first and second housings for preventing relative movement between said first and second housings when said insertion end portion of said first housing is inserted into said second housing so as to maintain electrical contact between said conductive contacts of said first electrical connector and said conductive terminals of said second electrical connector;

wherein said fastening unit includes:

a fastener-mounting seat mounted fixedly on said first housing, disposed on one of top and bottom sides of said first housing, and having an engagement surface, which is formed with a through hole that extends through said fastener-mounting seat;

a coupling member mounted fixedly on said second housing, disposed on one of top and bottom sides of said second housing that corresponds to said one of said top and bottom sides of said first housing, and having an engagement surface, which is formed with a thread hole; and a fastener mounted movably and rotatable in said through hole in said fastener-mounting seat and having an operating end portion extending outwardly of said fastener-mounting seat, and a threaded coupling end portion opposite to said operating end portion, said fastener being movable relative to said fastener-mounting seat toward said coupling member such that said threaded coupling end portion has a maximum extension extending outwardly of said engagement surface of said fastener-mounting seat and having a length smaller than that of said insertion end portion of said first housing, said operating end portion being operated so as to enable said coupling end portion to engage said thread hole in said coupling member when said insertion end portion of said first housing is inserted into said second housing.

2. The electrical connector assembly as claimed in claim 1, wherein said coupling member is configured as a nut, and said engagement surface of said fastener-mounting seat is formed with a positioning groove for engaging fittingly an end of said coupling member when said insertion end portion of said first housing is inserted into said second housing.

3. The electrical connector assembly as claimed in claim 2, wherein said coupling end portion of said fastener is formed with a stop flange extending radially and outwardly therefrom and abutting against said end of said coupling member when said coupling end portion of said fastener engages said thread hole in said coupling member.

4. The electrical connector assembly as claimed in claim 1, wherein said fastening unit includes:

a first coupling block mounted fixedly on one of said first and second housings and formed with an integral engaging tongue; and a second coupling block mounted fixedly on the other one of said first and second housings and formed with an engaging groove, said engaging groove engaging fittingly said engaging tongue on said first coupling block when said insertion end portion of said first housing is inserted into said second housing.

5. An electrical connector assembly comprising:

a first electrical connector including a first housing that has an insertion end portion extending along a direction and formed with a receiving space that is defined by an inner wall surface, and a set of conductive contacts disposed in said receiving space and mounted on said inner wall surface;

a second electrical connector including a hollow second housing that has an opening and that permits extension of said insertion end portion of said first housing thereinto via said opening, a terminal-mounting seat disposed in said second housing and received fittingly in said receiving space in said insertion end portion of said first housing when said insertion end portion of said first housing is inserted into said second housing, and a set of conductive terminals mounted on said terminal-mounting seat and contacting electrically and respectively said conductive contacts of said first electrical connector when said insertion end portion of said first housing is inserted into said second housing; and a fastening unit provided on said first and second housings for preventing relative movement between said first and second housings when said insertion end portion of said first housing is inserted into said second housing so as to maintain electrical contact between said conductive contacts of said first electrical connector and said conductive terminals of said second electrical connector;

wherein said second housing has an inner wall surface formed with an engaging hole; and wherein said fastening unit includes a resilient member having a mounting end portion fixed on said insertion end portion of said first housing, an operating end portion opposite to said mounting end portion, an intermediate abutting portion interconnecting said mounting end portion and said operating end portion and abutting against said inner wall surface of said second housing when said insertion end portion of said first housing is inserted into said second housing, said intermediate abutting portion being formed with an engaging projection corresponding to said engaging hole in said second housing, and a biasing portion connected to said intermediate abutting portion for biasing said engaging projection on said intermediate abutting portion to engage said engaging hole in said second housing when said insertion end portion of said first housing is inserted into said second housing.

6. An electrical connector assembly comprising:

a first electrical connector including a first housing that has an insertion end portion extending along a direction and formed with a receiving space that is defined by an inner wall surface, and a set of conductive contacts disposed in said receiving space and mounted on said inner wall surface;

a second electrical connector including a hollow second housing that has an opening and that permits extension of said insertion end portion of said first housing thereinto via said opening, a terminal-mounting seat disposed in said second housing and received fittingly in said receiving space in said insertion end portion of said first housing when said insertion end portion of said first housing is inserted into said second housing, and a set of conductive terminals mounted on said terminal-mounting seat and contacting electrically and respectively said conductive contacts of said first electrical connector when said insertion end portion of said first housing is inserted into said second housing; and a fastening unit provided on said first and second housings for preventing relative movement between said first and second housings when said insertion end portion of said first housing is inserted into said second housing so as to maintain electrical contact between said conductive contacts of said first electrical connector and said conductive terminals of said second electrical connector;

wherein said fastening unit includes:

a clamper mounted fixedly on one of said first and second housings and having a pair of resilient clamping arms, each of which has a clamping plate end portion extending toward the other one of said clamping arms and formed with a notch; and an engaging seat mounted fixedly on the other one of said first and second housings and having an annular outer surface that is formed with an annular groove to define a neck portion of said engaging seat, said annular groove extending around said neck portion, said clamping plate end portions of said clamping arms of said clamper engaging said annular groove in said engaging seat and clamping said neck portion of said engaging seat therebetween when said insertion end portion of said first housing is inserted into said second housing.

7. The electrical connector assembly as claimed in claim 6, wherein said notch in said clamping plate end portion of each of said clamping arms is semicircular, said engaging seat further having a tapered end portion connected integrally to said neck portion for guiding said clamping arms to clamp said neck portion of said engaging seat.

* * * * *